US009157646B2

(12) United States Patent
Anderson et al.

(10) Patent No.: US 9,157,646 B2
(45) Date of Patent: Oct. 13, 2015

(54) AUTOMATIC CHANGEOVER CONTROL FOR AN HVAC SYSTEM

(75) Inventors: Amy L. Anderson, Ramey, MN (US); Gary Yang, Tianjin (CN); Camel Zhang, Tianjin (CN); Angela Zhao, Tainjin (CN); Paul Wacker, Plymouth, MN (US); Nicholas Dalsin, Minneapolis, MN (US)

(73) Assignee: Honeywell International Inc., Morristown, NJ (US)

( * ) Notice: Subject to any disclaimer, the term of this patent is extended or adjusted under 35 U.S.C. 154(b) by 1090 days.

(21) Appl. No.: 12/881,058

(22) Filed: Sep. 13, 2010

(65) Prior Publication Data

US 2012/0061068 A1 Mar. 15, 2012

(51) Int. Cl.
*F25B 29/00* (2006.01)
*F24F 11/00* (2006.01)

(52) U.S. Cl.
CPC ..... *F24F 11/0009* (2013.01); *F24F 11/0012* (2013.01); *F24F 2011/0064* (2013.01); *F24F 2221/54* (2013.01)

(58) Field of Classification Search
CPC ..... F24F 11/0009; F24F 11/0064; F24F 11/0012; F24F 2011/0009; F24F 2011/0012; F24F 2221/54; F24F 2011/0064
USPC ..... 165/253–255; 700/276; 236/1 C
See application file for complete search history.

(56) References Cited

U.S. PATENT DOCUMENTS 3,815,668 A 6/1974 Carlson
3,825,852 A 7/1974 Pinckaers
4,316,256 A 2/1982 Hendricks et al.
4,386,649 A * 6/1983 Hines et al. ..... 165/239
4,446,913 A 5/1984 Krocker
4,632,177 A 12/1986 Beckey
4,799,176 A 1/1989 Cacciatore
5,192,020 A 3/1993 Shah
5,560,422 A * 10/1996 Matumoto et al. ..... 165/253
6,681,848 B2 1/2004 Breeden
7,641,126 B2 1/2010 Schultz et al.
2005/0189429 A1 9/2005 Breeden
2006/0186214 A1 * 8/2006 Simon et al. ..... 236/1 C
2006/0192021 A1 8/2006 Schultz et al.
2007/0045444 A1 3/2007 Gray et al.
2007/0131784 A1 * 6/2007 Garozzo et al. ..... 236/51
2009/0001181 A1 * 1/2009 Siddaramanna et al. ... 236/46 R
2009/0140060 A1 * 6/2009 Stoner et al. ..... 236/51

* cited by examiner

*Primary Examiner* — Cheryl J Tyler
*Assistant Examiner* — Orlando E Aviles Bosques
(74) *Attorney, Agent, or Firm* — Seager, Tufte & Wickhem, LLP

(57) ABSTRACT

Methods and apparatus for automatically changing between heating and cooling in an HVAC system. In one example, an HVAC controller may monitor the temperature of an inside space of a building, and may switch the HVAC system to cooling when the temperature of the inside space rises above a high switch-point temperature, and may cool the inside space to at least below the high switch-point temperature. The HVAC controller may also switch the HVAC system to heating when the temperature of the inside space falls below a low switch-point temperature and may heat the inside space to at least above the low switch-point temperature. In some cases, after switching to heating or cooling, the HVAC controller may cause the HVAC system to heat or cool the inside space, respectively, to substantially the set-point temperature.

6 Claims, 10 Drawing Sheets

AUTOMATIC CHANGEOVER CONTROL FOR AN HVAC SYSTEM

FIELD

The present disclosure relates generally to building control systems, and more particularly, to the control of building control systems with both heating and cooling modes.

BACKGROUND

Heating, ventilation, and/or air conditioning (HVAC) systems are often used to control the comfort level within an inside space of a building. Many HVAC systems include an HVAC controller or other device that activates and deactivates one or more HVAC components of the HVAC system to affect and control one or more environmental conditions within the building. These environmental conditions can include, but are not limited to, temperature, humidity, and/or ventilation. Many HVAC systems have the ability to heat and cool the inside space of a building.

SUMMARY

The present disclosure relates generally to building control systems, and more particularly, to the control of HVAC systems that have both heating and cooling modes. In one illustrative embodiment, the HVAC system may contain an HVAC controller that controls the operation of the HVAC system. The HVAC controller may include at least one set-point temperature, as well as a low switch-point temperature and a high switch-point temperature, where the low switch-point temperature is below the set-point temperature and the high switch-point temperature is above the set-point temperature.

The HVAC controller may monitor the temperature of an inside space of a building, and may switch the HVAC system to the cooling mode when the temperature of the inside space rises above the high switch-point temperature and may cool the inside space to at least below the high switch-point temperature. The HVAC controller may also switch the HVAC system to the heating mode when the temperature of the inside space falls below the low switch-point temperature and may heat the inside space to at least above the low switch-point temperature. In some cases, after switching to the heating mode, the HVAC controller may cause the HVAC system to heat the inside space to substantially the set-point temperature. Likewise, after switching to the cooling mode, the HVAC controller may cause the HVAC system to cool the inside space to substantially the set-point temperature. As can be seen, and in some sense, the present disclosure may relate to methods and apparatus for automatically changing (auto changeover) between heating and cooling modes of an HVAC system, sometimes using a single or common setpoint in both modes for increased comfort.

The preceding summary is provided to facilitate an understanding of some of the innovative features unique to the present disclosure and is not intended to be a full description. A full appreciation of the disclosure can be gained by taking the entire specification, claims, drawings, and abstract as a whole.

BRIEF DESCRIPTION

The disclosure may be more completely understood in consideration of the following detailed description of various illustrative embodiments of the disclosure in connection with the accompanying drawings, in which.

DESCRIPTION

Figure 1:
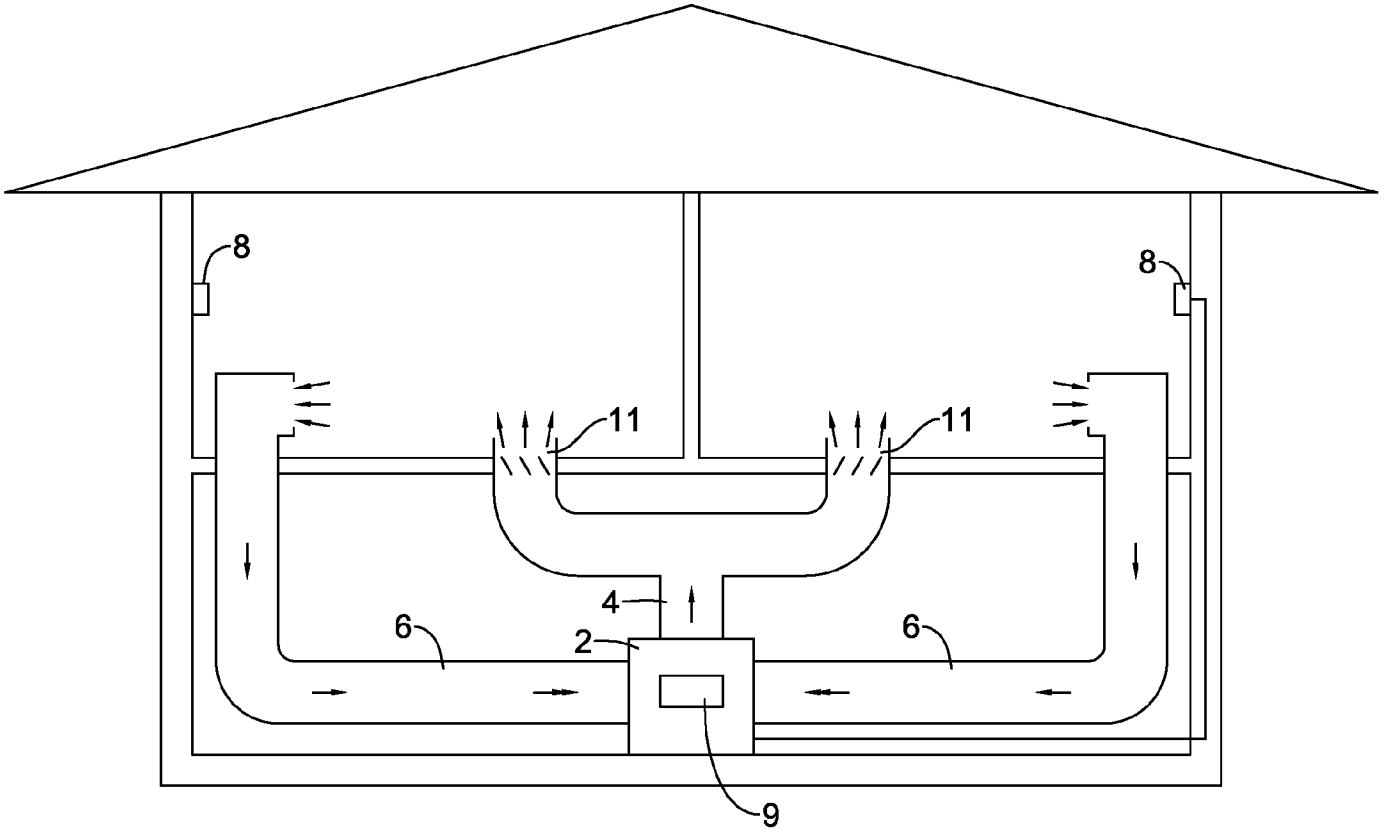
FIG. 1 is a schematic view of an example building including an illustrative heating, ventilating, and air conditioning (HVAC) system.

The following description should be read with reference to the drawings wherein like reference numerals indicate like elements throughout the several views. The description and drawings show several embodiments which are meant to be illustrative.

FIG. 1 is a schematic view of an example building including an HVAC system. While FIG. 1 shows a typical forced air type HVAC system, other types of HVAC systems may be used including hydronic systems, boiler systems, radiant heating systems, electrical heating systems, combinations thereof, and/or any other suitable type of HVAC system, as desired. The illustrative HVAC system of FIG. 1 includes one or more HVAC components 2, a system of vents or ductwork 4 and 6, and one or more HVAC devices, such as HVAC controller 8. The one or more HVAC components 2 may include, but are not limited to, a furnace, a boiler, a heat exchanger, an air cleaner, a source of hot and/or cold water, and/or any other suitable HVAC components.

In the illustrative HVAC system shown in FIG. 1, the one or more HVAC components 2 can provide heated air (and/or cooled air) via the ductwork throughout the inside space of the building. As illustrated, the one or more HVAC components 2 may be in fluid communication with every room and/or zone in the building via the ductwork 4 and 6. In operation, when one or more of the HVAC controllers 8 switches on the HVAC heating mode, one or more HVAC components 2 (e.g. forced warm air furnace) may be activated to supply heated air to one or more rooms and/or zones within the building via supply air ducts 4. The heated air may be forced through supply air duct 4 by a blower or fan 9. In this example, the cooler air from each zone may be returned to the one or more HVAC components 2 (e.g. forced warm air furnace) for heating via return air ducts 6.

Similarly, when one or more of the HVAC controllers 8 switches on the HVAC cooling mode, the one or more HVAC components 2 (e.g. air conditioning unit) may be activated to supply cooled air to one or more rooms and/or zones within the building or other structure via supply air ducts 4. The cooled air may be forced through supply air duct 4 by the blower or fan 9. In this example, the warmer air from each zone may be returned to the one or more HVAC components 2 (e.g. air conditioning unit) for cooling via return ducts 6.

In some cases, the system of vents or ductwork 4 and 6 can include one or more dampers 11 to regulate the flow of air. For example, one or more dampers 11 may be coupled to one or more of the HVAC controllers 8 and can be coordinated with the operation of one or more HVAC components 2. The one or more HVAC controllers 8 may actuate dampers 11 to an open position, a closed position, and/or a partially open position to modulate the flow of air from the one or more HVAC components 2 to an appropriate room and/or zone in the building or other structure. The dampers 11 may be particularly useful in zoned HVAC systems, and may be used to control which zone(s) receives conditioned air from the HVAC components 2.

While a forced air type HVAC system is shown in FIG. 1, it is contemplated that any suitable HVAC system may be used. For example, it is contemplated that the HVAC system may be a fan coil HVAC system, such as often used in Hotels and/or other such buildings. In some fan coil HVAC systems, a source of hot and/or cold water may be provided to a heat exchanger of a local fan coil unit. When heating and/or cooling is desired, a fan may circulate or blow air across the heat exchanger to provide hot and/or cold air. In some cases, the hot and/or cold water may be provided pipes, but this is not required.

In any event, it is contemplated that the one or more HVAC controllers 8 may be configured to control the comfort level of the building by activating and deactivating the one or more HVAC components 2. In some cases, the one or more HVAC controllers 8 may be thermostats, such as, for example, wall mountable thermostat, but this is not required in all embodiments. In some embodiments, the one or more HVAC controllers 8 may be wired, wireless, or both. In some embodiments, the HVAC controllers 8 may be zone controllers, each controlling the comfort level within a particular zone in the building or other structure. The one or more HVAC controllers 8 may be configured to control and/or set one or more functions and/or parameters, such as, for example, schedules, set-points, switch-points, trend logs, timers, and/or other building functions or parameters, as desired.

Figure 2:
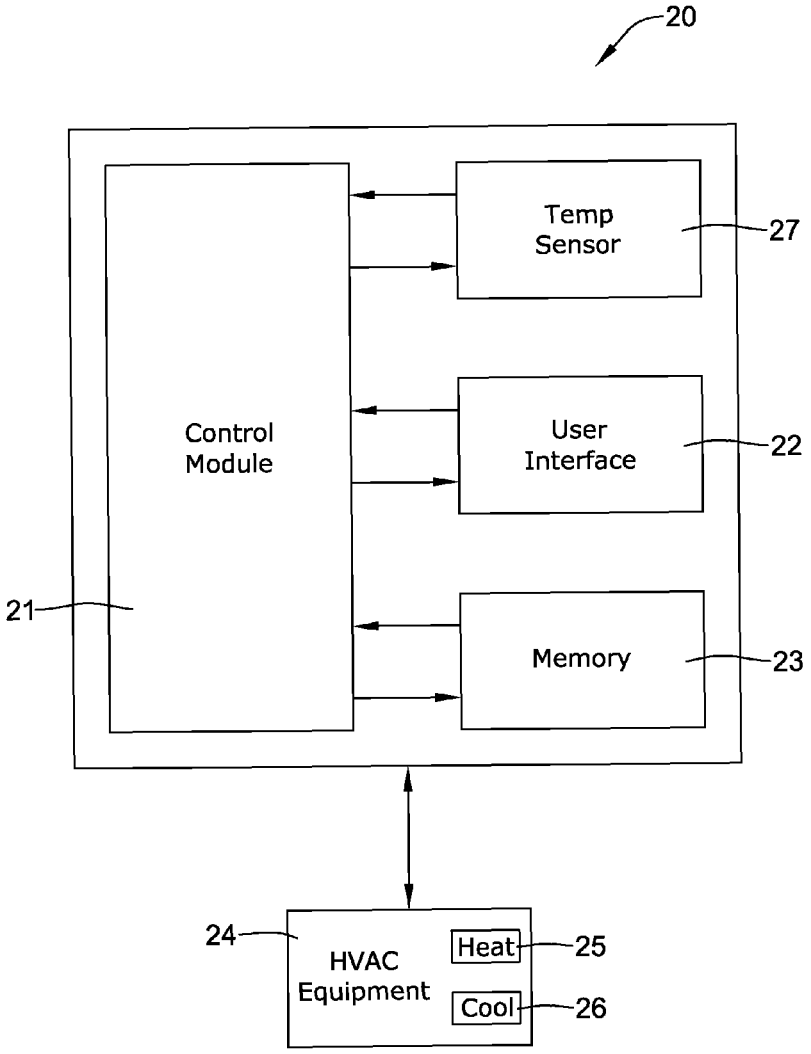
FIG. 2 is a schematic block diagram of an illustrative HVAC controller that may be used in conjunction with an HVAC system.

FIG. 2 is a schematic block diagram of an illustrative HVAC controller 20 that may be used in conjunction with an HVAC system 24. The HVAC system 24 may have a heating unit 25 and a cooling unit 26. In some cases, the HVAC controller 20 may be considered to be a thermostat, but this is not required. In the illustrative embodiment, the HVAC controller 20 includes a control module 21, a user interface 22, a memory 23, and a temperature sensor 27. Although not shown in FIG. 2, the HVAC controller 20 may include a wired or wireless interface so that data may be sent to and/or gathered from the HVAC controller 20.

Control module 21 of HVAC controller 20 may be configured to control the comfort level (i.e. heating, cooling, ventilation, air quality, etc.) of an inside space of a building by controlling whether the HVAC components 25 and/or 26 of HVAC system 24 are activated or not. In some instances, control module 21 may include a processor, microcontroller and/or some other controller, which can be programmed to perform certain functions. It is contemplated that control module 21 may be configured to control and/or set one or more HVAC functions, such as, for example, HVAC schedules, temperature set-points, temperature switch-points, humidity set-points, trend logs, timers, environment sensing, HVAC controller programs, user preferences, and/or other HVAC functions or programs, as desired. In some illustrative embodiments, control module 21 may be programmed to control the comfort level of at least a portion of the building using a temperature sensed by one or more local and/or remote temperature sensors 27.

Control module 21 may be configured to operate in accordance with an algorithm that controls or at least partially controls one or more components of the HVAC system 24. In some instances, the algorithm may include or reference a number of operating parameters. Examples of components that may be controlled by control module 21 include one or more of a furnace, a boiler for hot water heat or steam heat, a heat pump, an air conditioning unit, a humidifier, a dehumidifier, an air exchanger, an air cleaner, a fan, and the like. In some instances, control module 21 may operate in accordance with an algorithm that references an HVAC schedule with temperature set-points, temperature switch-points, starting and/or ending times, and/or the like.

Memory 23 may be electrically connected to control module 21, and may be used to store any desired information, such as the aforementioned HVAC schedules, temperature set-points, temperature switch-points, humidity set-points, trend logs, timers, environmental settings, and/or any other settings and/or information as desired. Memory 23 may include any suitable type of memory, such as, for example, random-access memory (RAM), read-only member (ROM), electrically erasable programmable read-only memory (EEPROM), Flash memory, or any other suitable memory, as desired. Control module 21 may store information, such as a plurality of parameters, within memory 23, and may subsequently retrieve the stored information from the memory 23.

User interface 22 may be any suitable interface that is electrically connected to control module 21 and configured to display and/or solicit information as well as permit a user to enter data and/or other parameters and/or settings such as temperature set-points, temperature switch-points, humidity set-points, starting times, ending times, and/or the like, as desired. In some cases, user interface 22 of the HVAC controller 20 may allow a user (e.g. owner, technician, or other person) to program and/or modify one or more control parameters of HVAC controller 20, such as programming temperature set-points, temperature switch-points, temperature differentials or offsets, start and stop times, equipment status and/or other parameters, as desired. In some instances, the user interface 22 may include a touch screen, a liquid crystal display (LCD) panel and keypad, a dot matrix display, a computer, one or more buttons and/or any other suitable user interface, as desired.

In some cases, the HVAC controller 20 may include or have access to one or more sensors, such as a temperature sensor 27, a humidity sensor, a ventilation sensor, an air quality sensor, and/or any other suitable building control system sensor, as desired. In some cases, the temperature sensor 27 may be contained within a housing of the HVAC controller 20 itself. In other cases, the temperature sensor 27 may be separate from the HVAC controller 20. In some cases, HVAC controller 20 may also include a data port configured to communicate with control module 21 and may, if desired, be used to either upload information to control module 21 or download information from control module 21. Information that can be uploaded or downloaded may include values of operating parameters, settings, firmware, and/or any other suitable information, as desired.

Figure 3:
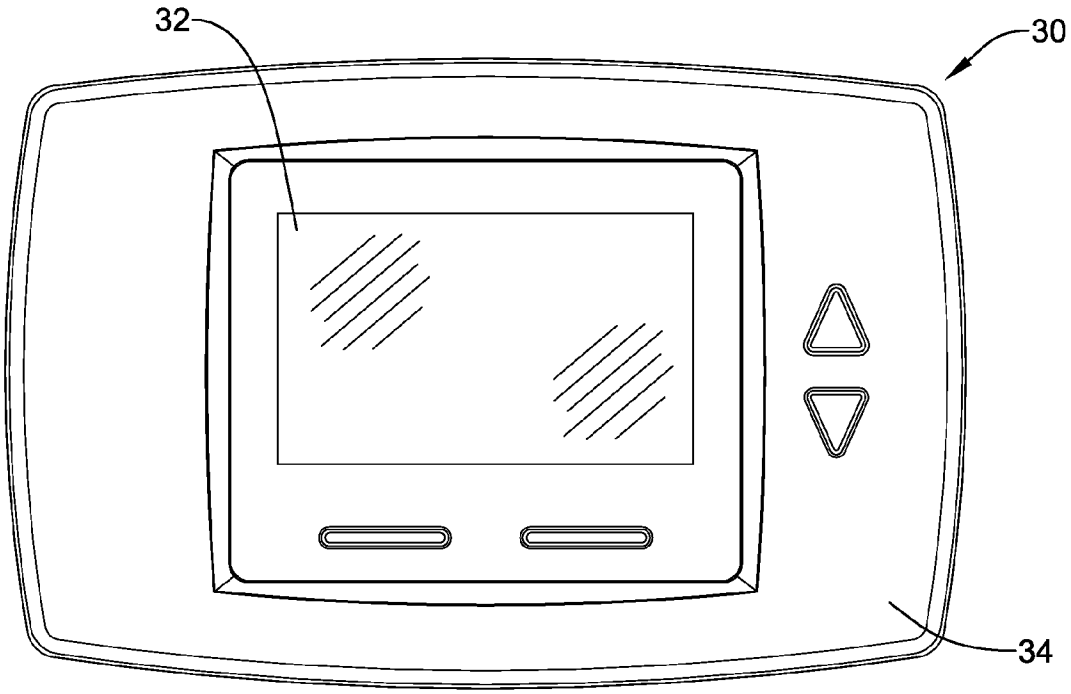
FIG. 3 is a front perspective view of an illustrative HVAC controller.

FIG. 3 is a front view of an illustrative HVAC controller 30. In some instances, HVAC controller 30 may represent a manifestation of HVAC controller 8 of FIG. 1 or HVAC controller 20 of FIG. 2, but this is not required. The illustrative HVAC controller 30 includes a display 32 that is disposed within a housing 34. In some cases, display 32 may be at least a portion of the user interface of the HVAC controller 30. Display 32 may be a touch screen display, a liquid crystal display (LCD) panel, a dot matrix display, a fixed segment display, a cathode ray tube (CRT), or any other suitable display, as desired. A dot matrix display is typically an LCD display that permits images such as letters, numbers, graphics, and the like to be displayed anywhere on the LCD, rather than being confined to predetermined locations such as is the case with a fixed segment LCD. Housing 34 may be formed of any suitable material, such as a polymeric, metallic, or any other material, as desired. In some cases, the display 32 may be either inset or recessed within the housing 34 as shown. In some cases, HVAC controller 30 may be configured to provide substantial display and/or programming functionality, but this is not required in all embodiments.

Figure 4:
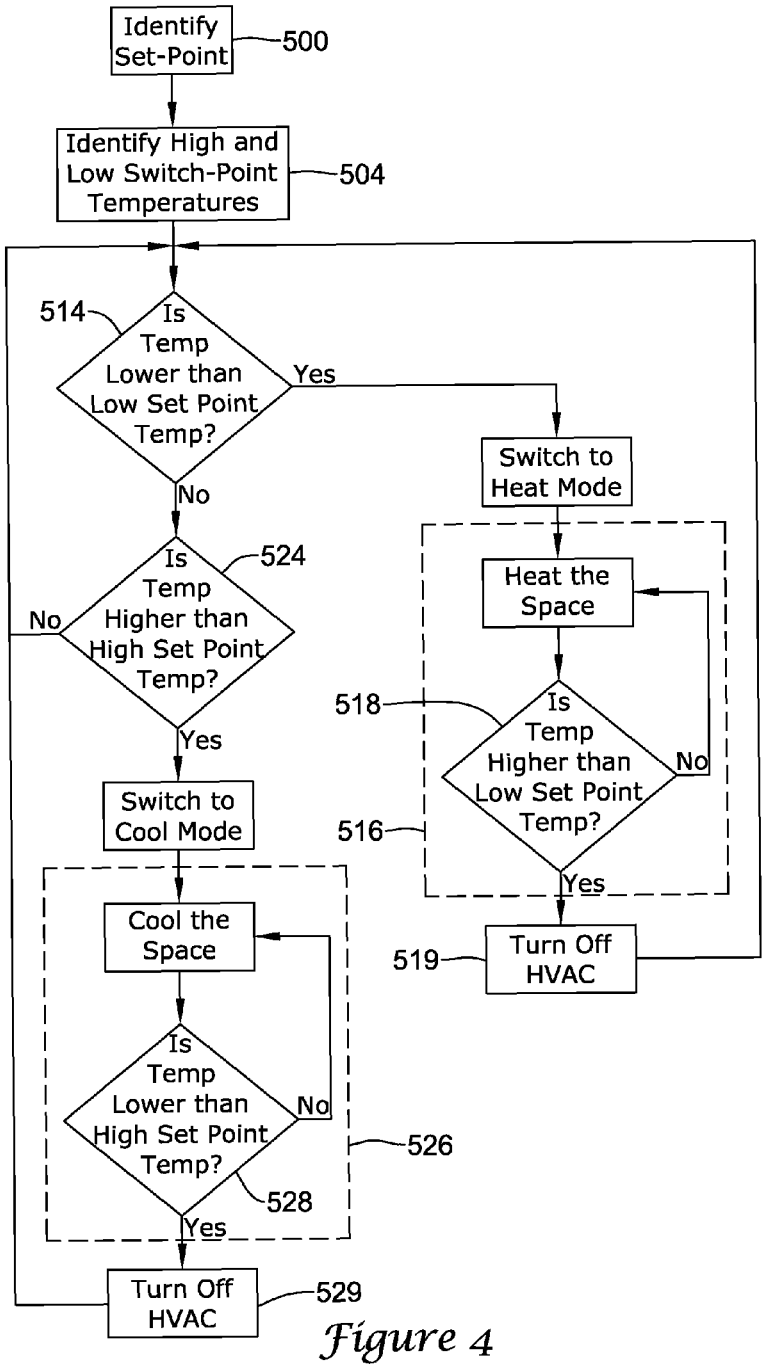
FIGS. 4 and 5A-5C are flow diagrams of illustrative methods of operating an HVAC controller to control an HVAC system.

FIG. 4 is flow diagram of an illustrative method for controlling the heating and cooling units of an HVAC system. The HVAC system may or may not be the HVAC system described in FIG. 1. The task of employing this method may be carried out by an HVAC controller. Such an HVAC controller may be, but is not required to be, HVAC controller 8 described in FIG. 2 or HVAC controller 30 described in FIG. 3.

As shown in block 500, a set-point temperature may be identified by the HVAC controller. This set-point temperature may be stored in a memory of an HVAC controller, such as memory 23 of HVAC controller 20. In some embodiments, the set-point temperature may be entered into the HVAC controller via a user interface, such as user interface 22. In some cases, the set-point temperature may be set to a default setting at the factory.

In block 504, the HVAC controller may identify the values of a low and a high switch-point temperature. In one example embodiment, the HVAC controller may automatically identify the values of the low and the high switch-point temperatures based on the value of the set-point temperature. In determining the values, the HVAC controller may employ an algorithm to calculate the values, such as +/−4 degrees above and below the set-point temperature. In another example, a user may define the values of the high and the low switch-point temperatures. The user may utilize a user interface, such as user interface 22, to program the values of the high switch-point temperature and the low switch-point temperature into the HVAC controller 20, or to program a differential or offset such as +/−4 degrees. In some cases, the low and high switch-point temperatures may set to a default setting at the factory.

In decision block 514, the HVAC controller determines if the temperature of the inside space is less than the low switch-point temperature. The HVAC controller can, for example, determine the temperature of the inside space through the use of a temperature sensor. In the illustrative embodiment, if the temperature is less than the low switch-point temperature, the HVAC controller switches the HVAC system to the heating mode. Control loop 516 then controls the heating of the inside space. Control loop 516 directs the HVAC system to heat the inside space in the heating mode until the temperature of the inside space rises above a low shut-off temperature. Once the temperature of the inside space rises above the low shut-off temperature, the HVAC controller exits control loop 516. Block 519 then commands the HVAC system to shut-off, at least temporarily. While not explicitly shown in FIG. 4, the HVAC controller may cycle the HVAC system on and off in the heating mode to maintain the temperature of the inside space at substantially the low shut-off temperature, if desired. In some embodiments, the low shut-off temperature is at least greater than the low switch-point temperature. In other embodiments, the low shut-off temperature may be substantially the same as the set-point temperature. The low shut-off temperature may be any value that is, for example, equal to or greater than the low switch-point temperature and equal to or less than the high switch-point temperature.

If the temperature of the inside space rises above the high switch-point temperature, decision block 524 directs the HVAC controller to switch the HVAC to the cooling mode. Control loop 526 then controls the cooling of the inside space. Control loop 526 directs the HVAC system to cool the inside space until the temperature of the inside space falls below a high shut-off temperature. Once the temperature of the inside space falls below the high shut-off temperature, the HVAC controller exits control loop 526. Block 529 then commands the HVAC system to shut-off, at least temporarily. While not explicitly shown in FIG. 4, the HVAC controller may cycle the HVAC system on and off in the cooling mode to maintain the temperature of the inside space at substantially the high shut-off temperature, if desired. In some embodiments, the high shut-off temperature is at least less than the high switch-point temperature. In other embodiments, the high shut-off temperature may be substantially the same as the set-point temperature. The high shut-off temperature may be any value that is, for example, equal to or less than the high switch-point and equal to or greater than the low switch-point.

Figure 5A:
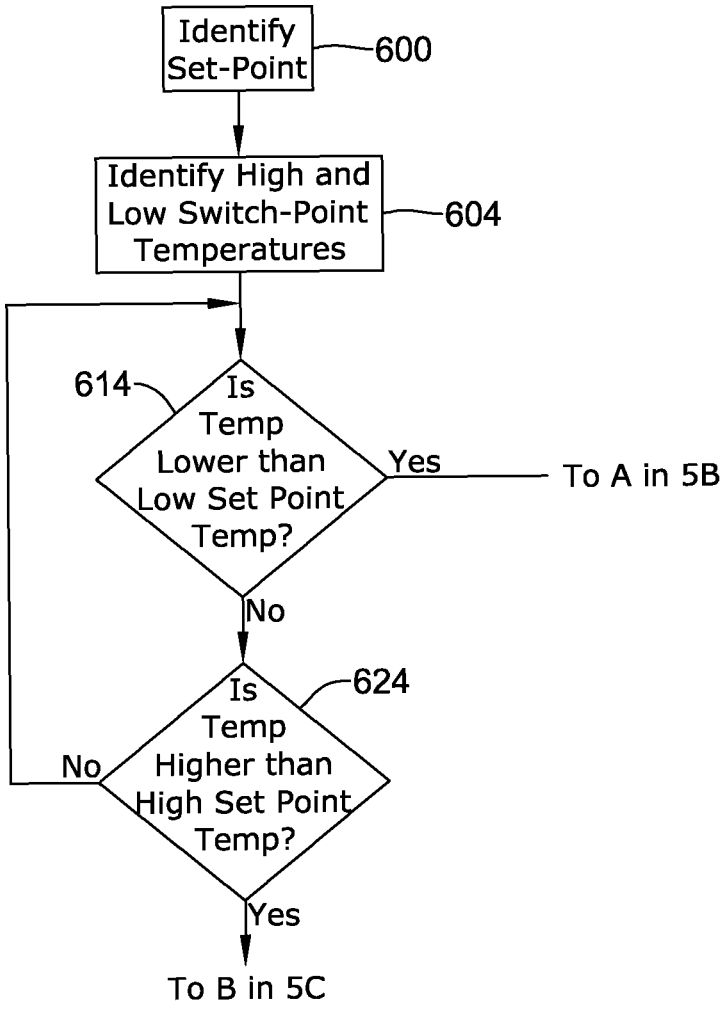
Figure 5B:
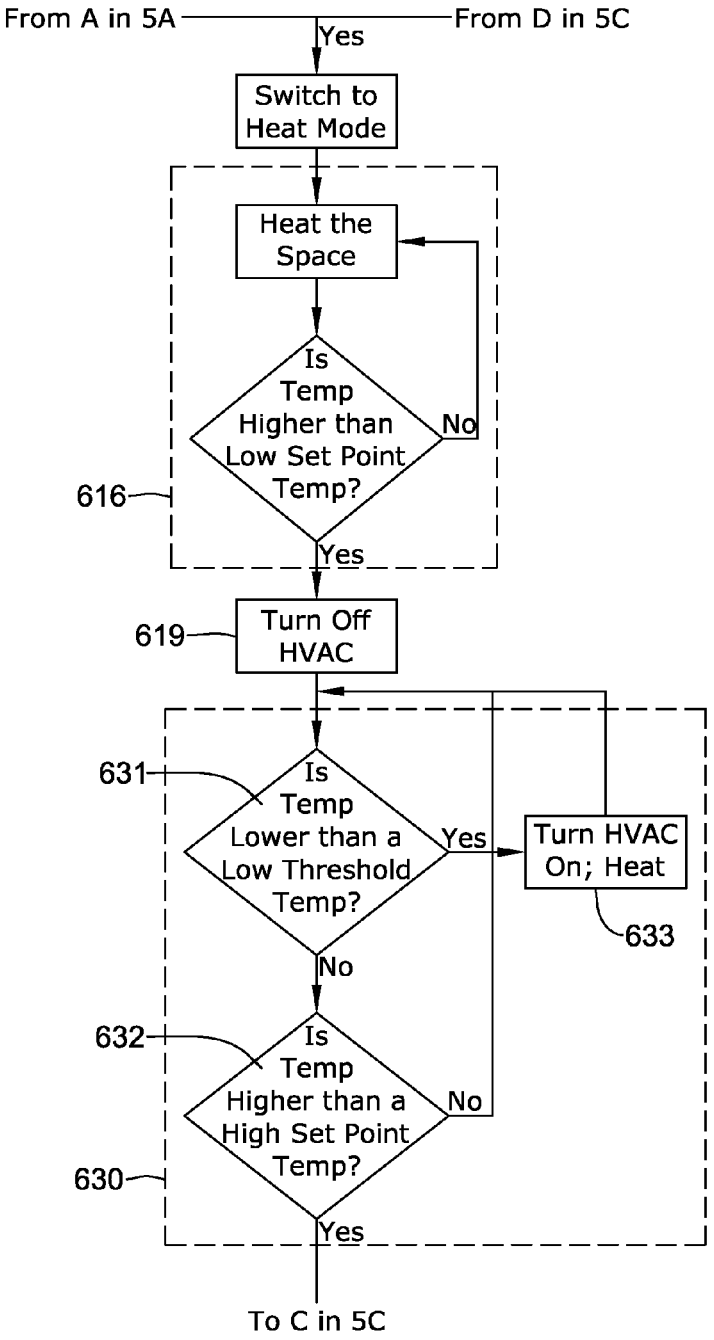
Figure 5C:
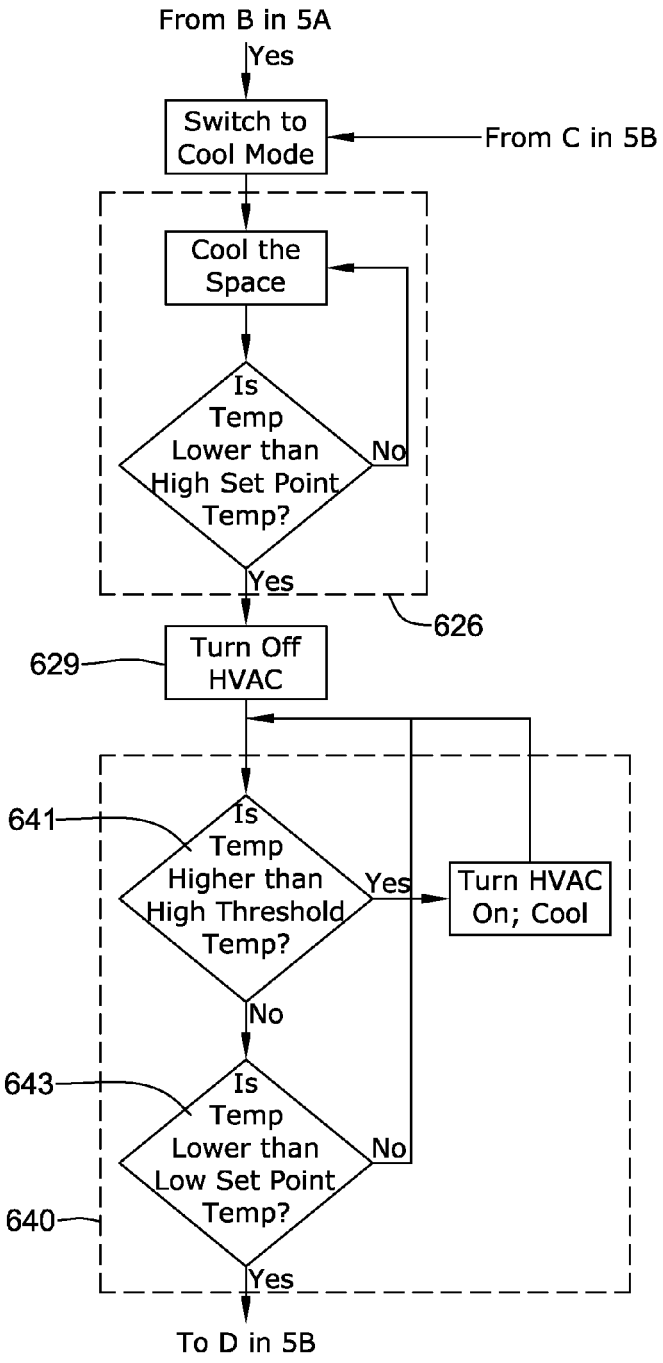

FIG. 5A-5C show a flow diagram of another illustrative method for controlling the heating and cooling units of an HVAC system. The HVAC system may, or may not be, the HVAC system described in FIG. 1. The task of employing this method may be carried out by an HVAC controller. Such an HVAC controller may be, but is not required to be, HVAC controller 8 described in FIG. 2 or HVAC controller 30 described in FIG. 3.

The illustrative method of 5A-5C begins with block 600 by identifying the set-point temperature. The set-point temperature may be stored into a memory of the HVAC controller, and may be set by a user using a user interface, such as user interface 22. The set-point temperature may also be set to a default setting at the factory, if desired. In block 604, the HVAC controller identifies the values of a low switch-point temperature and a high switch-point temperature. In one example, the HVAC controller may automatically determine the values of the low and the high switch-point temperatures based on the value of the set-point temperature. In determining the values, the HVAC controller may employ an algorithm to calculate the values, such as +/−4 degrees above and below the set-point temperature. In another example, a user may define the values of the high and the low switch-point temperatures. The user may utilize a user interface, such as user interface 22, to program the values of the high switch-point temperature and the low switch-point temperature into the HVAC controller 20. Additionally, the low and high switch-point temperatures may set to a default setting at the factory.

In decision block 614, the HVAC controller determines if the temperature of the inside space is less than the low switch-point temperature. The HVAC controller may monitor the temperature of the inside space through a temperature sensor, which may or may not be part of the HVAC controller itself. If the temperature is less than the low switch-point temperature, the HVAC controller may switch the HVAC system to the heating mode. Control loop 616 then controls the heating of the inside space. Control loop 616 directs the HVAC system to heat the inside space until the temperature of the inside space rises above the low shut-off temperature. Once the temperature of the inside space rises above the low shut-off temperature, the HVAC controller exits control loop 616. In some embodiments, the low shut-off temperature is at least greater than the low switch-point temperature. In other embodiments, the low shut-off temperature may be substantially the same as the set-point temperature. The low shut-off temperature may also be any value that is, for example equal to or greater than the low switch-point temperature and equal to or less than the high switch-point temperature.

After exiting control loop 616, block 619 turns the HVAC system off and the HVAC controller enters a temperature control mode. One embodiment of a temperature control mode may be described by the block diagram outlined in box 630. The temperature control mode allows for more precise control over the temperature of the inside space. Once the HVAC system switches to the heating mode and heats the inside space to the low shut-off temperature, the temperature control mode may provide for the temperature of the inside space to remain near the shut-off temperature.

Decision block 631 of the temperature control mode box 630 determines if the temperature of the inside space is less than a low threshold temperature. If the temperature is not less than the low threshold temperature, decision block 632 determines if the temperature of the inside space is greater than the high switch-point temperature. If the temperature of the inside space is not greater than the high switch-point temperature, the HVAC controller loops back to decision block 631. At decision block 631, if the temperature of the inside space is less than the low threshold temperature, the HVAC controller directs the HVAC system to turn on and heat the inside space until the temperature of the inside space rises above the low shut-off temperature. The low threshold temperature is preferably lower than the low shut-off temperature, but higher than the low switch-point temperature. In one embodiment of the invention, the low threshold temperature is 1 degree F. less than the low shut-off temperature, providing a small dead band below the low shut-off temperature. In another embodiment, the low threshold temperature is 0.5 degrees F. less than the low shut-off temperature. Other values for the low threshold temperature may be used as well. In at least some embodiments, the low threshold temperature may not be less than the low switch-point temperature. Note, while in the temperature control mode 630, if the temperature of the inside space should rises above the high switch-point temperature, the HVAC controller switches the HVAC system to the cooling mode and control loop 626 begins to control the cooling of the building.

Referring back to decision block 614, if the temperature of the inside space is not lower than the low switch-point temperature, decision block 624 determines if the temperature of the inside space is greater than the high switch-point temperature. If the temperature of the inside space is not greater than the high switch-point temperature, then the HVAC controller loops back to decision block 614. This loop may continue until the temperature of the inside space rises above or falls below the high or low switch-point temperatures.

If, at decision block 624, the temperature of the inside space is greater than the high switch-point temperature, the HVAC controller switches the HVAC system to the cooling mode. Control loop 626 then controls the cooling of the inside space. Control loop 626 directs the HVAC system to cool the inside space until the temperature of the inside space falls below the high shut-off temperature. Once the temperature of the inside space falls below the high shut-off temperature, the HVAC controller exits control loop 626. In some embodiments, the high shut-off temperature is at least less than the high switch-point temperature. In other embodiments, the high shut-off temperature may be substantially the same as the set-point temperature. It is contemplated that the high shut-off temperature may be any value that is, for example, equal to or less than the high switch-point temperature and equal to or greater than the low switch-point temperature.

After exiting control loop 626, block 629 turns the HVAC system off and the HVAC controller enters a temperature control mode. One embodiment of a temperature control mode may be described by block 640. In block 640, decision block 641 determines if the temperature of the inside space is greater than a high threshold temperature. If the temperature is not greater than the high threshold temperature, decision block 643 determines if the temperature of the inside space is less than the low switch-point temperature. If the temperature of the inside space is not less than the low switch-point temperature, the HVAC controller loops back to decision block 641. At decision block 641, if the temperature of the inside space is greater than the high threshold temperature, the HVAC controller directs the HVAC system to turn on and cool the inside space until the temperature of the inside space falls below the high shut-off temperature. The high threshold temperature is preferably higher than the high shut-off temperature, but lower than the high switch-point temperature. In one embodiment, the high threshold temperature is 1 degree F. greater than the high shut-off temperature. In another embodiment, the high threshold temperature is 0.5 degrees F. greater than the high shut-off temperature. Other values for the high threshold temperature may be used as well. In at least some embodiments, the high threshold temperature may not be greater than the high switch-point temperature. While in the temperature control mode, if the temperature of the inside space falls below the low switch-point temperature, the HVAC controller switches the HVAC system to the heating mode, and control loop 616 controls the heating of the building.

Figure 6:
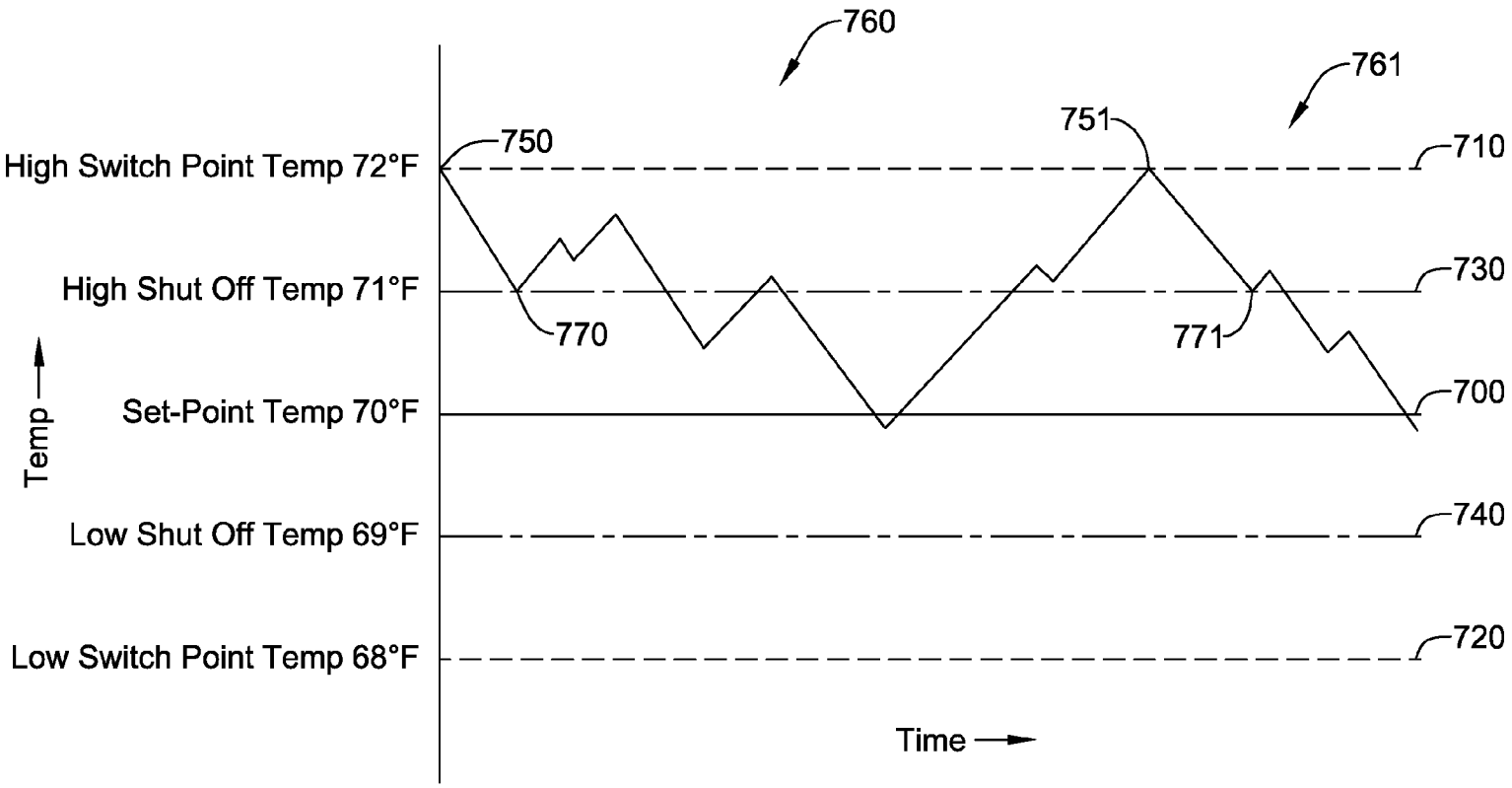
FIGS. 6 and 7 are graphs that help illustrate the method of FIG. 4.

FIG. 6 depicts a graph of the temperature of a space versus time. In this graph, an HVAC controller is controlling an HVAC system to heat and cool a space using the method described by FIG. 4. The HVAC system may or may not be the HVAC system described in FIG. 1. The HVAC controller may be, but is not required to be, HVAC controller 8 described in FIG. 2 or HVAC controller 30 described in FIG. 3.

In this example, the set-point temperature 700 has been set to a temperature of 70 degrees F. As described above, set-point temperature 700 may be set at any suitable temperature, and may be set in any suitable manner. The high switch-point temperature 710 has been set to 72 degrees F., and the low switch-point temperature 720 has been set to 68 degrees F. The switch-point temperatures 710 and 720 may be set at any suitable temperature, and may be set in any suitable manner. In FIG. 6, the high shut-off temperature 730 and the low shut-off temperature 740 have also been identified, with high shut-off temperature being 71 degrees F. and low shut-off temperature being 69 degrees F. As described earlier, the shut-off temperatures 730 and 740 may be set at any suitable temperature, and may be set in any suitable manner. In some cases, the low shut-off temperature 740 and/or the high shut-off temperature 730 may be at or substantially at the set point temperature 700.

FIG. 6 contains two regions, region 760 and region 761, which help illustrate the functioning of an illustrative HVAC controller. In region 760, at cooling switch-point 750, the HVAC controller switches the HVAC system to the cooling mode and the HVAC system begins cooling the inside space. As depicted in FIG. 6, the system actively cools the inside space until the temperature of the inside space reaches the high shut-off temperature 730, at shut-off point 770. At shut-off point 770, the HVAC controller directs the HVAC system to shut-off. After shut-off point 770, the temperature of the inside space may be allowed to float until the temperature again crosses one of the switch-point temperatures 710 or 720. For purposes of illustration, this happens again at cooling switch-point 751. At cooling switch-point 751, the HVAC controller directs the HVAC system to turn on and to cool the inside space back down to the high shut-off temperature 730. Once the temperature of the inside space reaches the high shut-off temperature 730, at shut-off point 771, the HVAC controller again directs the HVAC system to shut-off. The temperature of the inside space may then be allowed to float, as indicated by region 761.

While not specifically shown in FIG. 6, after the HVAC system reaches the high shut-off point 770, the HVAC controller may cycle the HVAC system on and off in the cooling mode to maintain the temperature of the inside space at substantially the high shut-off temperature 730 (which may, in some cases, be at or substantially at the setpoint temperature 700), rather than allowing the temperature of the inside space to float upward to the high switch-point temperature 710. Since the HVAC system is in the cooling mode, the temperature of the inside space may be allowed to float downward to the low switch-point temperature 720, at which point the HVAC controller may switch the HVAC system to the heating mode (see FIG. 7).

Figure 7:
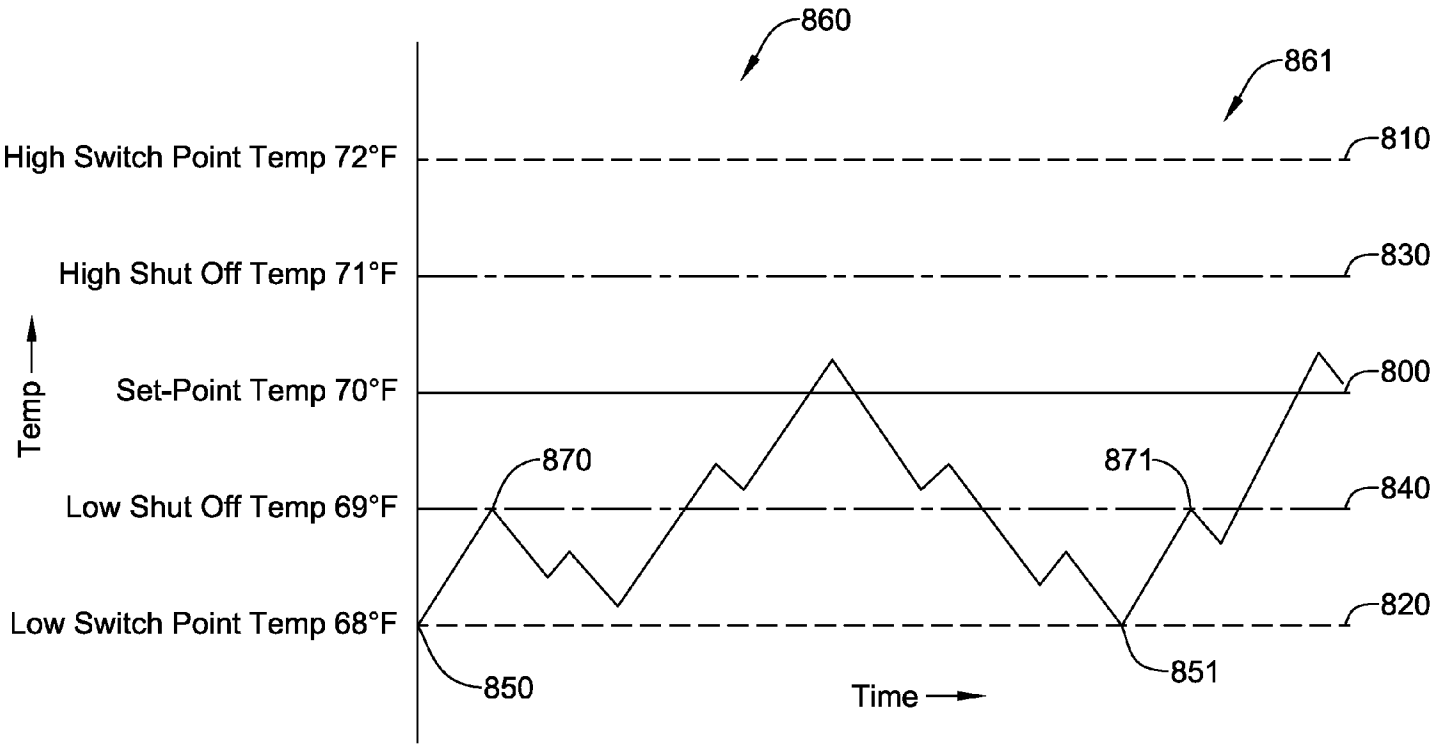

FIG. 7 also depicts a graph that helps illustrate the method of controlling an HVAC system as described above in FIG. 4. In this example, a set-point temperature 800 has been set to a temperature of 70 degrees F. A high switch-point temperature 810 has been set to 72 degrees F., and the low switch-point temperature 820 has been set to 68 degrees F. Also, a high shut-off temperature 830, and the low shut-off temperature 840 have also been identified, with the high shut-off temperature 830 being 71 degrees F. and the low shut-off temperature 840 being 69 degrees F.

Figure 8:
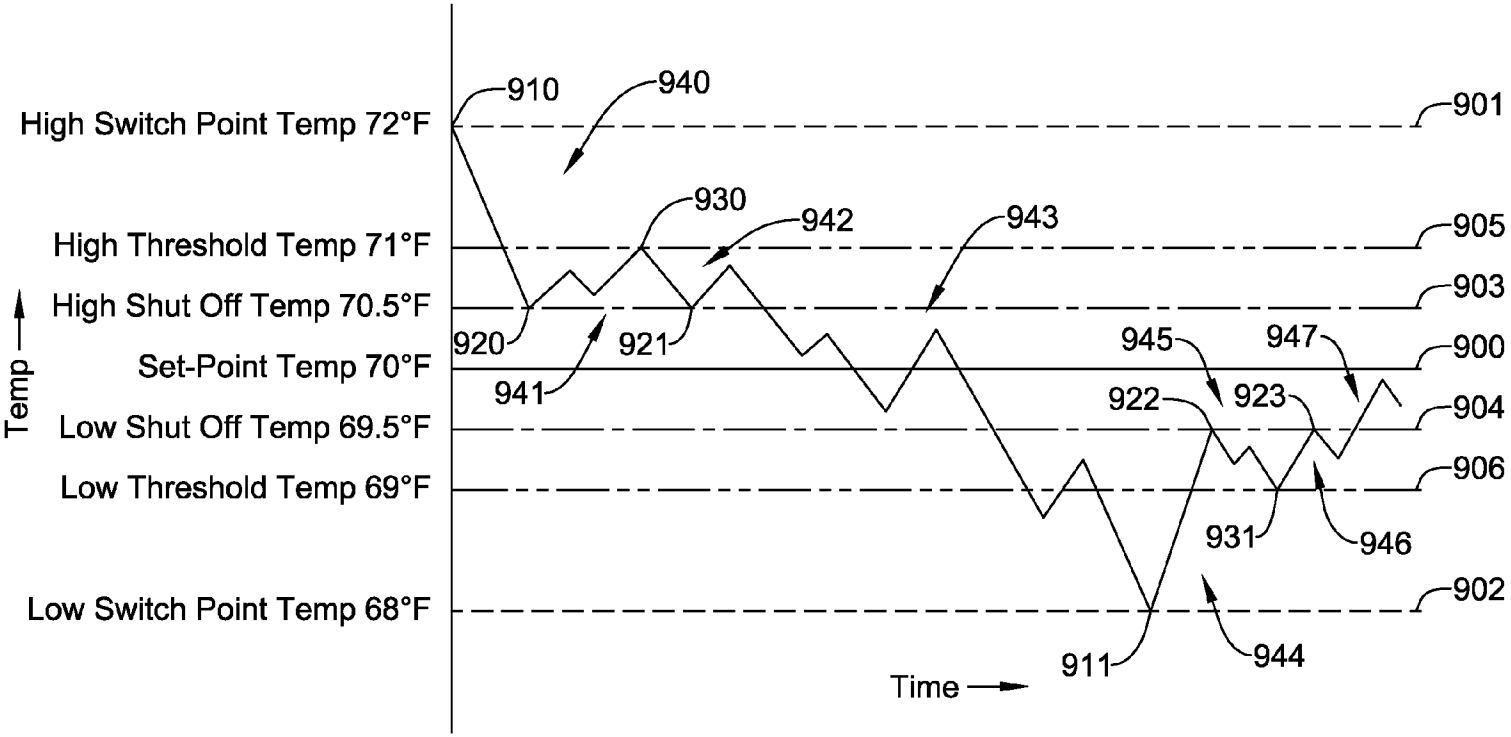
FIG. 8 is a graph that helps illustrate the method of FIG. 5A-5C.

FIG. 7 contains 2 regions, region 860 and region 861, which help to illustrate the functioning of the HVAC system controller. In region 860, at heating switch-point 850, the HVAC controller switches the HVAC system to the heating mode, and the HVAC system begins heating the inside space. As depicted in FIG. 8, the HVAC system actively heats the inside space until the temperature of the inside space reaches the low shut-off temperature 840, at shut-off point 870. In some cases, the low shut-off temperature 840 and/or the high shut-off temperature 830 may be at or substantially at the set point temperature 800.

At shut-off point 870, the HVAC controller directs the HVAC system to shut-off. After shut-off point 870, the temperature of the inside space may be allowed to float until the temperature again crosses one of the switch-point temperatures 810 or 820. For purposes of illustration, this happens again at heating switch-point 851. At heating switch-point 851, the HVAC controller directs the HVAC system to turn on and to heat the inside space back up to the low shut-off temperature 840. Once the temperature of the inside space reaches the low shut-off temperature 840, at shut-off point 871, the HVAC controller again directs the HVAC system to shut-off. The temperature of the inside space may then be allowed to float, as indicated by region 861.

While not specifically shown in FIG. 7, after the HVAC system reaches the shut-off point 870, the HVAC controller may cycle the HVAC system on and off in the heating mode to maintain the temperature of the inside space at substantially the low shut-off temperature 840 (which may, in some cases, be at or substantially at the setpoint temperature 800), rather than allowing the temperature of the inside space to float downward to the low switch-point temperature 820. Since the HVAC system is in the heating mode, the temperature of the inside space may be allowed to float upward to the high switch-point temperature 810, at which point the HVAC controller may switch the HVAC system to the cooling mode (see FIG. 6).

FIG. 8 is a graph of the temperature of an inside space versus time that helps illustrate the method of FIG. 5A-5C. In this example embodiment, a set-point temperature 900 has been set to a temperature of 70 degrees F. A high switch-point temperature 901 has been set to 72 degrees F., and the low switch-point temperature 902 has been set to 68 degrees F. A high shut-off temperature 903 and the low shut-off temperature 904 have also been identified, with the high shut-off temperature 903 being 70.5 degrees F. and the low shut-off temperature 904 being 69.5 degrees F. Also, a high threshold temperature 905 has been set at 71 degrees F., and a low threshold temperature 906 has been set at 69 degree F. The values of the high and low threshold temperatures 905 and 906 are meant as examples only.

FIG. 8 contains a number of regions including regions 940, 941, 942, 943, 944, 945, 946, and 947, which help to illustrate the functioning of this example HVAC controller. At cooling switch-point 910, the HVAC controller switches the HVAC system to the cooling mode and directs the HVAC system to cool the inside space. Region 940 depicts a time period where the HVAC system is actively cooling the inside space. In the example shown, once the temperature of the inside space reaches the high shut-off temperature 903, at shut-off point 920, the HVAC controller directs the HVAC system to shut-off. The HVAC controller then enters a temperature control mode. One example of a temperature control mode has been described with reference to FIG. 5A-5C. After entering the temperature control mode, the temperature of the inside space may be allowed to float within a restricted temperature range. Region 941 of the graph shows the temperature of the inside space floating. When the HVAC controller enters the temperature control mode after cooling the inside space to the high shut-off temperature 903, the temperature of the inside space is only allowed to rise up to the high threshold temperature 905. Once the temperature reaches the high threshold temperature 905, such as at threshold point 930, the HVAC controller turns the HVAC system on and directs the HVAC system to cool the inside space back down to the high shut-off temperature 903, such as at shut-off point 921. Region 942 depicts a time period during where the HVAC system is actively cooling the inside space. After shut-off point 921, the temperature of the inside space is again allowed to float but not above the high threshold temperature 905. Region 943 illustrates the temperature of the inside space floating. After actively cooling the inside space to the high shut-off temperature 903, the temperature of the inside space is only allowed to fall as far as the low switch-point temperature 902.

Once the temperature of the inside space reaches the low switch-point temperature 902, such as at switch-point 911, the HVAC controller directs the HVAC system to switch to the heating mode, and to heat the inside space up to the low shut-off temperature 904. Region 944 depicts a time period where the HVAC system is actively heating the inside space. Once the temperature of the inside space reaches the low shut-off temperature 904, at shut-off point 922, the HVAC controller turns the HVAC system off. The HVAC controller then enters a temperature control mode. After entering the temperature control mode, the temperature of the inside space is allowed to float within a restricted temperature range. Region 945 depicts the temperature of the inside space floating. When the HVAC controller enters the temperature control mode after heating the inside space to the low shut-off temperature 904, the temperature of the inside space is only allowed to fall to the low threshold temperature 906. Once the temperature reaches the low threshold temperature 906, such as at threshold point 931, the HVAC controller turns the HVAC system on and directs the HVAC system to heat the inside space back up to the low shut-off temperature 904, such as at shut-off point 923. Region 946 depicts a time period where the HVAC system is actively heating the inside space. After Shut-off point 923, the temperature of the inside space is allowed to float but not below the low threshold temperature 906. Region 947 illustrates the temperature of the inside space floating. The highest temperature to which the temperature of the inside space is allowed to float is the high switch-point temperature 901.

Having thus described the preferred embodiments of the present disclosure, those of skill in the art will readily appreciate that yet other embodiments may be made and used within the scope of the claims hereto attached. It will be understood that this disclosure is, in many respect, only illustrative. The scope, of course, is defined in the language in which the appended claims are expressed.

What is claimed is:

1. A method of operating an HVAC system that is capable of controlling the temperature of an inside space of a building, the HVAC system having both a heating unit and an air conditioning unit, the method comprising:

monitoring a temperature of the inside space of the building;

identifying a set-point temperature;

identifying a low switch-point temperature and a high switch-point temperature, wherein the low switch-point temperature is below the set-point temperature and the high switch-point temperature is above the set-point temperature;

causing the HVAC system to heat the inside space using the heating unit when the temperature of the inside space falls below the low switch-point temperature, and to heat the inside space to a low shutoff temperature that is above the low switch-point temperature, and after the HVAC system heats the inside space to the low shutoff temperature, cycling the heating unit of the HVAC system on and off to control the temperature of the inside space between the low shutoff temperature and a low threshold temperature, wherein the low threshold temperature is below the set-point temperature but above the low switch-point temperature;

causing the HVAC system to cool the inside space using the air conditioning unit when the temperature of the inside space rises above the high switch-point temperature, and to cool the inside space to a high shutoff temperature that is below the high switch-point temperature, and after the HVAC system cools the inside space to the high shutoff temperature, cycling the air conditioning unit of the HVAC system on and off to control the temperature of the inside space between the high shutoff temperature and a high threshold temperature, wherein the high threshold temperature is above the set-point temperature but below the high switch-point temperature;

wherein the low shutoff temperature is below the set-point temperature and above the low threshold temperature, and wherein the high shut-off temperature is above the set-point temperature and below the high threshold temperature.

2. The method of claim 1 further comprising providing a set-back mode, wherein when the HVAC system is switched to the set-back mode, the set-point temperature, the high switch-point temperature, and the low switch-point temperature all change to different pre-determined set-back values.

3. The method of claim 1, wherein the HVAC system further comprises an HVAC controller including a memory for storing at least one of the set-point temperature, the high switch-point temperature and the low switch-point temperature.

4. The method of claim 3, where the memory further stores at least one set-back set-point temperature.

5. The method of claim 3, where the HVAC controller is configured as a wall-mountable thermostat that includes an internal temperature sensor.

6. The method of claim 1, wherein the HVAC system is a fan coil system.

* * * * *